US008288948B2

(12) United States Patent
Hwang et al.

(10) Patent No.: US 8,288,948 B2
(45) Date of Patent: Oct. 16, 2012

(54) PLASMA DISPLAY PANEL HAVING BARRIER WALLS WITH BASE PORTIONS AND PROTRUDING PORTIONS

(75) Inventors: Eui-Jeong Hwang, Suwon-si (KR); Seung-Hyun Son, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 59 days.

(21) Appl. No.: 12/801,449

(22) Filed: Jun. 9, 2010

(65) Prior Publication Data

US 2011/0050084 A1 Mar. 3, 2011

(30) Foreign Application Priority Data

Aug. 28, 2009 (KR) ..... 10-2009-0080699

(51) Int. Cl.
*H01J 17/49* (2012.01)

(52) U.S. Cl. ..... 313/583; 313/582; 313/585; 313/587

(58) Field of Classification Search ..... 313/582–587
See application file for complete search history.

(56) References Cited

U.S. PATENT DOCUMENTS

| | | | | |
|---|---|---|---|---|
| 6,456,007 | B1 * | 9/2002 | Ryu et al. | 313/586 |
| 6,873,103 | B2 | 3/2005 | Takada et al. | |
| 7,034,443 | B2 | 4/2006 | Ahn et al. | |
| 7,999,473 | B2 * | 8/2011 | Son et al. | 313/583 |
| 2004/0095067 | A1 * | 5/2004 | Yasui et al. | 313/582 |
| 2004/0169470 | A1 * | 9/2004 | Inoue | 313/582 |
| 2005/0264200 | A1 * | 12/2005 | Kang et al. | 313/582 |
| 2006/0071595 | A1 * | 4/2006 | Woo et al. | 313/584 |
| 2006/0113914 | A1 * | 6/2006 | Fujitani et al. | 313/586 |
| 2008/0224612 | A1 * | 9/2008 | Song | 313/586 |
| 2009/0128035 | A1 | 5/2009 | Nam et al. | |
| 2009/0200945 | A1 * | 8/2009 | Okuyama et al. | 313/643 |

FOREIGN PATENT DOCUMENTS

| | | |
|---|---|---|
| JP | 11-213903 | 8/1999 |
| JP | 2003-031130 | 1/2003 |
| JP | 2004-342447 | 12/2004 |
| JP | 2005-174850 | 6/2005 |
| KR | 10-1999-0075037 | 10/1999 |
| KR | 10-0683668 | 2/2007 |

OTHER PUBLICATIONS

Korean Office Action issued by Korean Patent Office on Feb. 17, 2011, corresponding to Korean Patent Application No. 10-2009-0080699 and Request for Entry of the Accompanying Office Action attached herewith.

* cited by examiner

*Primary Examiner* — Sikha Roy
(74) *Attorney, Agent, or Firm* — Robert E. Bushnell, Esq.

(57) ABSTRACT

A plasma display panel including a front substrate and a rear substrate facing each other; a barrier wall interposed between the front substrate and the rear substrate, including base portions arranged on either side of a main discharge space and protruding portions protruding on the base portions, and defining stepped spaces on either side of the main discharge space; a scan and a sustain electrode pair including a pair of bus electrodes disposed in the main discharge space and a pair of transparent electrodes extending from the bus electrodes toward the stepped space; an address electrode that generates, together with the scan electrode, an address discharge and crossing the scan electrode; a phosphor layer formed across the main discharge space and the stepped spaces; and a discharge gas filled in the main discharge space and the stepped spaces.

20 Claims, 5 Drawing Sheets

PLASMA DISPLAY PANEL HAVING BARRIER WALLS WITH BASE PORTIONS AND PROTRUDING PORTIONS

CLAIM OF PRIORITY

This application makes reference to, incorporates the same herein, and claims all benefits accruing under 35 U.S.C. §119 from an application entitled PLASMA DISPLAY PANEL earlier filed in the Korean Intellectual Property Office on Aug. 28, 2009 and there duly assigned Serial No. 10-2009-0080699.

BACKGROUND OF THE INVENTION

1. Field of the Invention

The present invention relates to a plasma display panel (PDP), and more particularly, to a highly efficient plasma display panel that can be driven with low power and obtain high luminous brightness.

2. Description of the Related Art

Plasma display panels are flat-panel display devices that form images by using visible light produced from a phosphor material excited with ultraviolet (UV) rays generated by a plasma discharge.

In the plasma display panels, a front substrate on which discharge electrodes are arranged and a rear substrate on which address electrodes are arranged are attached to each other while a plurality of barrier walls defining a plurality of discharge cells are interposed between the front and rear substrates. A discharge gas is injected between the two substrates, and then a phosphor material coating the discharge cells is excited by applying a discharge voltage between the discharge electrodes. Then, images are displayed using visible light generated as a result of the excitation.

In a related art, a large portion of a phosphor layer is attached to side surfaces of barrier walls, and flowable phosphor paste does not securely adhere to the side surfaces of the barrier walls and flows down. Thus, phosphor remaining on the side surfaces has neither a sufficient nor regular thickness. In addition, visible light generated from the phosphor is not emitted upward, that is, in a display direction, but is discharged in a side surface direction of the barrier walls. Thus, visible light extraction efficiency is low. Since bottom surfaces of the discharge cells where phosphor is concentrated are apart from a front substrate having discharge electrodes arranged thereon, a sufficient amount of UV light does not reach the phosphor and thus fails to effectively excite the phosphor. Since an address discharge occurs along a long discharge path corresponding to the height of a discharge cell, a high address driving voltage is required, and a sufficient voltage margin is not obtained.

SUMMARY OF THE INVENTION

One or more embodiments of the present invention include a highly efficient plasma display panel (PDP) that can be driven with low power and obtain high luminous brightness.

Additional aspects will be set forth in part in the description which follows and, in part, will be apparent from the description, or may be learned by practice of the presented embodiments.

According to one or more embodiments of the present invention, a plasma display panel includes a front substrate and a rear substrate that face each other; a barrier wall interposed between the front substrate and the rear substrate, including base portions arranged on either side of a main discharge space and protruding portions protruding on the base portions, and defining stepped spaces on either side of the main discharge space, wherein the stepped spaces are formed according to stepped surfaces formed by the base portions and the protruding portions; a pair of a scan electrode and a sustain electrode including a pair of bus electrodes disposed in the main discharge space and a pair of transparent electrodes extending from the bus electrodes toward the stepped space; an address electrode that generates, together with the scan electrode, an address discharge and is elongated to cross an elongation direction of the scan electrode; a phosphor layer formed across the main discharge space and the stepped spaces; and a discharge gas filled in the main discharge space and the stepped spaces.

The bus electrodes, which make a pair, may be disposed in between the base portions arranged on either side of the main discharge space.

A distance Lb between respective outer ends of the bus electrodes, which make a pair, may have a relationship of $La-Lb>10\ \mu m$, where La is a distance between the base portions disposed on either side of the main discharge space.

Extended widths of the transparent electrodes Xa and Ya, which correspond to lengths extended from the bus electrodes, may be designed to be each at least 10 μm.

A distance between extended ends of the transparent electrodes and the protruding portions may be designed to be at least 10 μm.

The barrier wall may include a horizontal barrier wall including the base portions and the protruding portions elongated in one direction, and a vertical barrier wall elongated to cross the direction in which the horizontal barrier walls are elongated. A channel space may be formed between adjacent horizontal barrier walls in a lengthwise direction of the horizontal barrier walls.

The scan electrode and the address electrode may cross with each other in the stepped space or in an area adjacent to the stepped space.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
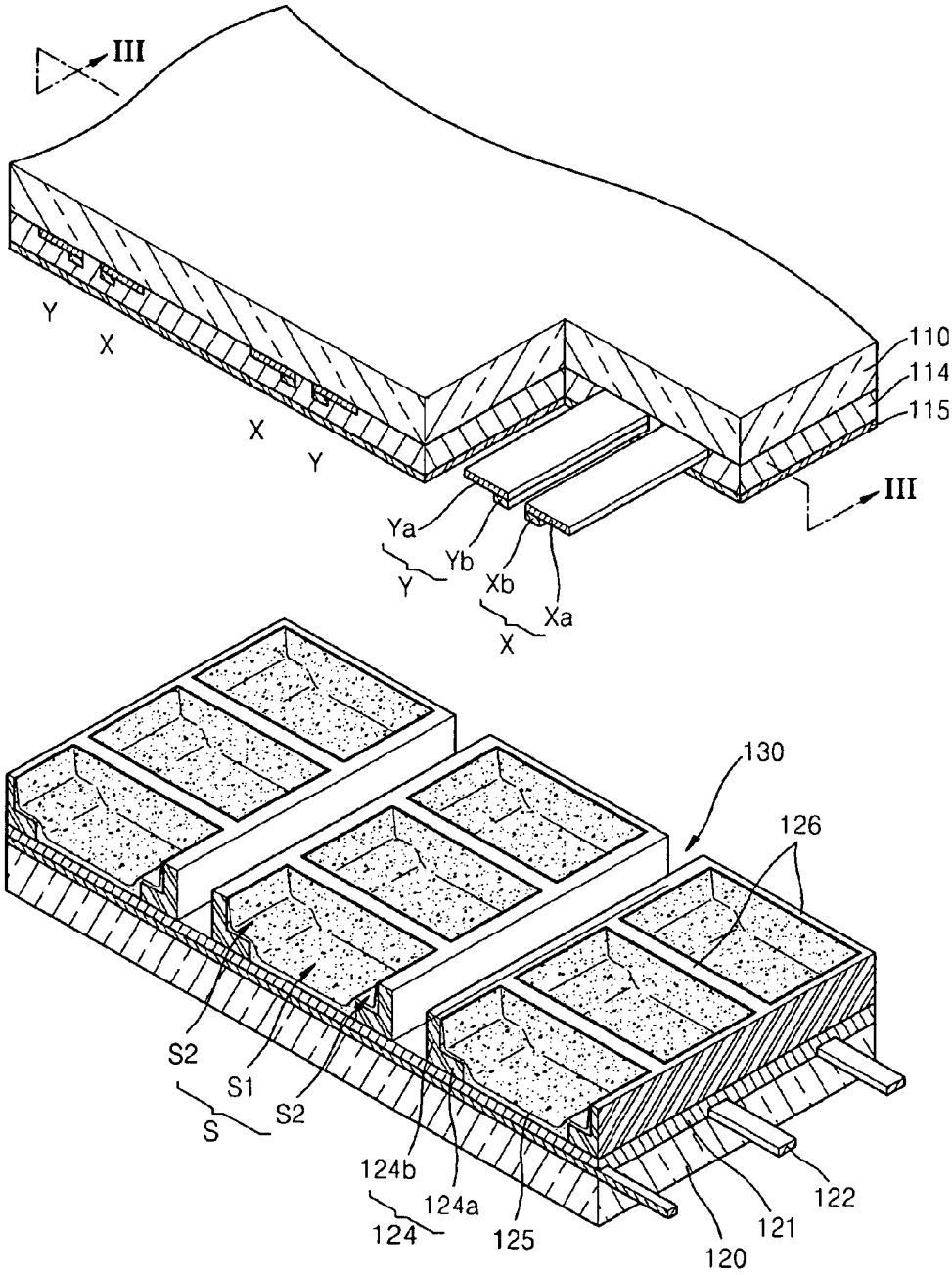
FIG. 1 is an exploded perspective view of a plasma display panel (PDP) according to an embodiment of the present invention.

Reference will now be made in detail to embodiments, examples of which are illustrated in the accompanying drawings, wherein like reference numerals refer to like elements throughout.

FIG. 1 is an exploded perspective view of a plasma display panel (PDP) according to an embodiment of the present invention.

Referring to FIG. 1, the plasma display panel includes a front substrate 110 and a rear substrate 120 that face each other with an interval (gap) therebetween, and barrier walls, including horizontal barrier walls 124 and vertical barrier walls 126, that define a plurality of unit cells S. For example, the barrier walls include the horizontal barrier walls 124 extending in one direction (horizontally) and the vertical barrier walls 126 extending in a second direction (vertically) to cross the extending direction of the horizontal barrier walls 124, and thus define unit cells S which are quasi-rectangular.

Each unit cell S denotes a minimal light-emitting unit that includes a discharge electrode pair (X,Y) formed to generate a mutual display discharge, and an address electrode 122 extending so as to intersect with the discharge electrode pair (X,Y). Each unit cell S is defined by the horizontal and vertical barrier walls 124 and 126 and thus forms a light-emission area independent from adjacent unit cells S. Each unit cell S includes a main discharge space S1 and stepped spaces S2 formed on either side of the main discharge space S1. A phosphor layer 125 is formed in each unit cell S.

The discharge electrode pair (X,Y) includes a sustain electrode X and a scan electrode Y that generate a display discharge. Each sustain electrode X includes a transparent electrode Xa formed of a phototransparent conductive material and a bus electrode Xb that electrically contacts the transparent electrode Xa and forms a power supply line. Each scan electrode Y includes a transparent electrode Ya formed of a phototransparent conductive material and a bus electrode Yb that electrically contacts the transparent electrode Ya and forms a power supply line. The transparent electrodes Xa and Ya have large widths and thus form a discharge electric field across a large area of each unit cell S. The bus electrodes Xb and Yb have small widths so as not to obstruct visible light and form a power supply line that transmits driving signals to the transparent electrodes Xa and Ya, respectively.

The discharge electrode pairs (X,Y) may be buried in a dielectric layer 114 so as to be protected from direct collision with charged particles that participate in the display discharge. The dielectric layer 114 may be covered with a protective layer 115 formed of an MgO (Magnesium oxide) thin film. The protective layer 115 may induce secondary electron emission to thereby contribute to discharge activation.

The scan electrodes Y and the sustain electrodes X may alternate with each other. Alternatively, as illustrated in FIG. 1, the scan electrodes Y and the sustain electrodes X may be arranged such that electrodes of the same kind are adjacent to each other in adjacent unit cells S. As illustrated in FIG. 1, a scan electrode Y, a sustain electrode X, a sustain electrode X, and a scan electrode Y are sequentially arranged, and thus a sustain electrode X in a unit cell S may be adjacent to a sustain electrode X in its adjacent unit cell S and similarly a scan electrode Y in a unit cell S may be adjacent to a scan electrode Y in its adjacent unit cell S. Due to this arrangement of the scan and sustain electrodes, an erroneous discharge in which a display discharge occurs across a cell boundary may be prevented, invalid power consumption may be reduced, and driving efficiency may be increased.

Figure 2:
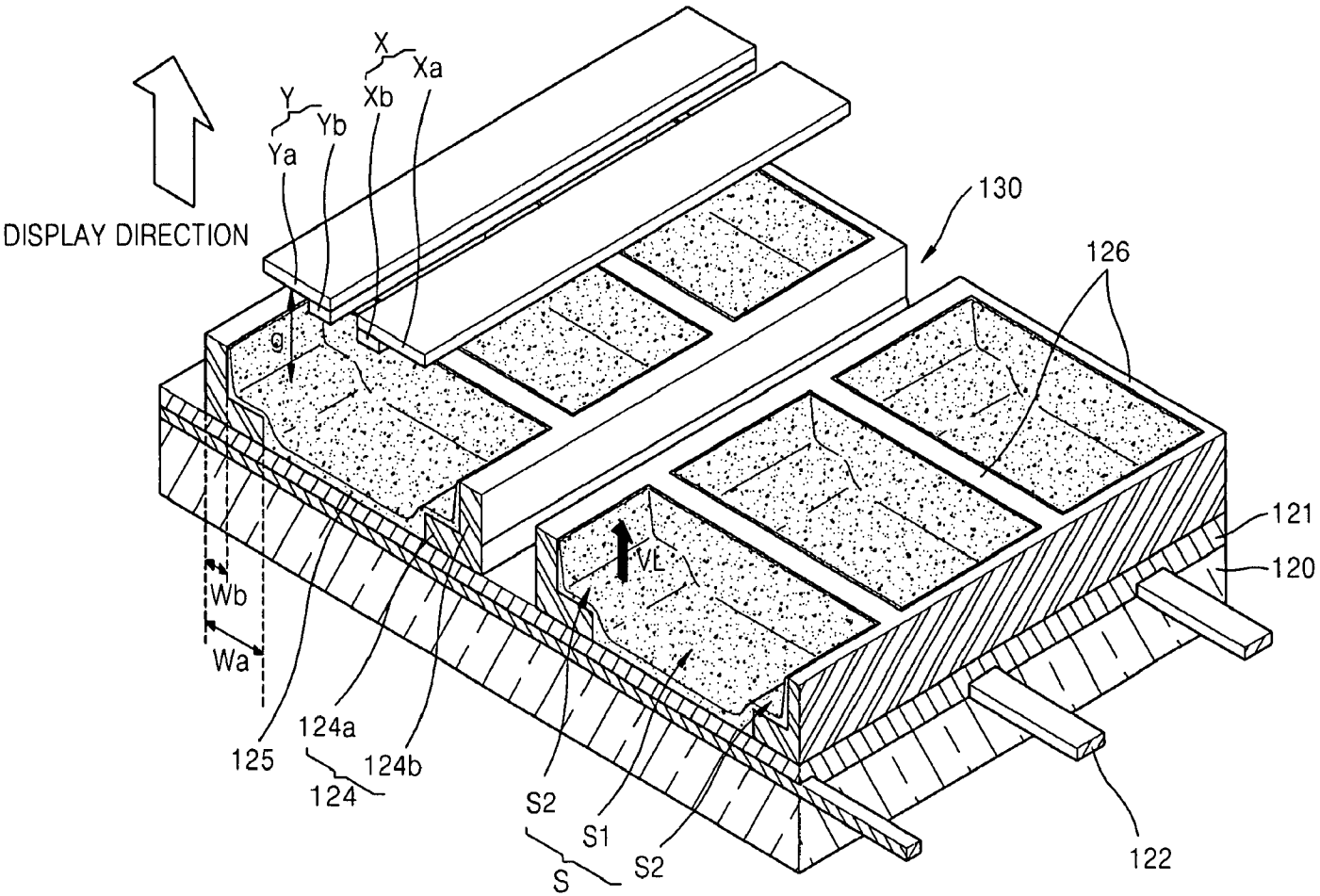
FIG. 2 is a perspective view of a major portion of the plasma display panel of FIG. 1.

FIG. 2 is an exploded perspective view of a major portion of the plasma display panel of FIG. 1. Referring to FIG. 2, the address electrodes 122 are arranged on the rear substrate 120. The address electrodes 122 perform an address discharge together with the scan electrodes Y. The address discharge denotes an auxiliary discharge that helps the display discharge by occurring prior to the display discharge and thus by accumulating priming particles in each of the unit cells S. The address discharge occurs mainly within the stepped spaces S2 existing on the horizontal barrier walls 124 that are stepped. In other words, the transparent electrodes Ya and the address electrodes 122 cross each other in the stepped spaces S2 or in an area adjacent to the stepped spaces S2, and while a discharge voltage applied to the scan electrodes Y and the address electrodes 122 is concentrated in the stepped spaces S2 via portions of the dielectric layer 114 covering the scan electrodes Y and portions of the horizontal barrier walls 124 existing on the address electrodes 122, a high electric field sufficient for discharge firing is formed within the stepped spaces S2. The stepped spaces S2 are not artificially partitioned by other wall structures and instead extend from the main discharge space S1 so as to form a single unit cell S together with the main discharge space S1. Priming particles formed due to the address discharge in the stepped spaces S2 naturally spread to the main discharge space S1 and participate in the display discharge. The stepped spaces S2 are defined by the horizontal barrier walls 124, which are stepped, and have small sizes compared with the sizes of the main discharge space S1.

The address electrodes 122 may be buried in a dielectric layer 121 formed on the rear substrate 120, and the horizontal and vertical barrier walls 124 and 126 may be formed on a flat plane provided by the dielectric layer 121. The horizontal and vertical barrier walls 124 and 126 may be the horizontal barrier walls 124 extending in one direction and the vertical barrier walls 126 extending to cross the extending direction of the horizontal barrier walls 124, and may form a matrix pattern that defines the unit cells S having quasi-rectangular shapes. For example, the horizontal barrier walls 124 may extend parallel to the scan electrodes Y, and the vertical barrier walls 126 may extend parallel to the address electrodes 122.

The horizontal barrier walls 124 each include the base portion 124*a* having a large width Wa and the protruding portion 124*b* formed on the base portion 124*a* to have a small width Wb, and have a stepped shape. The stepped spaces S2 defined by the horizontal barrier walls 124 exist between the scan electrodes Y and the address electrodes 122, and the scan electrodes Y and the address electrodes 122 generate an address discharge in the stepped spaces S2. Portions of the dielectric layer 114 (or the protective layer 115) that cover the scan electrodes Y, and portions of the base portions 124*a* that exist on the address electrodes 122 may form discharge surfaces and generate an address discharge. In other words, since the portions of the dielectric layer 114 covering the scan electrodes Y and the portions of the base portions 124*a* existing on the address electrodes 122 have a high dielectric constant, a discharge electric field may be concentrated in the stepped spaces S2 and an intensive address discharge may occur in the stepped spaces S2.

In a related art barrier wall structure, a discharge occurs between the scan electrodes Y and the address electrodes 122 along a long discharge path corresponding to the height of a cell. However, in the proposed barrier wall structure having the base portions 124*a* formed to have a predetermined height toward the scan electrodes Y, a discharge path between the scan electrodes Y and the address electrodes 122 has a decreased gap g from the base portions 124*a* to the scan electrodes Y. Thus, compared with the related art barrier wall structure, the proposed barrier wall structure may produce as many priming particles as the number of priming particles produced in the related art barrier wall structure, at an address voltage lower than that used in the related art barrier wall structure, and thus driving power consumption may be reduced. When an address voltage equal to that used in the related art barrier wall structure is applied, more priming particles than those produced in the related art barrier wall structure may be produced, and thus luminous efficiency may increase. The barrier walls 124 and 126 may be formed of a material having a dielectric constant equal to or greater than a certain level so as to form a high address electric field within the stepped space S2 via the base portions 124*a*, which are parts of the barrier walls 124 and 126. For example, the barrier walls 124 and 126 may be formed of a dielectric material such as lead oxide (PbO), diboron trioxide ($B_2O_3$), silicon dioxide ($SiO_2$), or titanium dioxide ($TiO_2$).

A channel space 130 may be defined between adjacent horizontal barrier walls 124 that define different unit cells S, and extend in a lengthwise direction of the horizontal barrier walls 124. The channel spaces 130 are non-discharge areas where a discharge is not supposed to occur. The channel spaces 130 serve as impurity gas flow paths in an exhaust process where impurity gas existing between the front substrate 110 and the rear substrate 120 attached to and facing each other is exhausted, thereby reducing flow resistance and the tact time of the exhaust process.

The stepped spaces S2 are formed on either side of the main discharge space S1. More specifically, the stepped spaces S2 are formed on the sides of a scan electrode Y and a sustain electrode X, respectively. An intensive address discharge occurs using one of the stepped spaces S2 which is on the side of the scan electrode Y, while the stepped space S2 formed on the side of the sustain electrode X establishes an equilibrium of each unit cell S together with the stepped space S2 on the side of the scan electrode Y. By designing the unit cells S each having a well-balanced shape, a display discharge may have a balanced discharge strength not biased toward any of the scan electrodes Y and the sustain electrodes X and have a nearly symmetrical shape. Therefore, a brightness distribution within each unit cell S may have a symmetrical shape, a light-emitting center representing maximum brightness may be approximately identical with the geometrical center of each unit cell S, and degradation of the quality of display due to an asymmetrical brightness distribution may be prevented.

A phosphor layer 125 is formed in each unit cell S. The phosphor layers 125 interact with ultraviolet (UV) rays produced as a result of the display discharge, thereby generating visible rays of different colors. For example, red (R), green (G), and blue (B) phosphor layers 125 are formed in the unit cells S according to colors to be displayed, so that the unit cells S are classified into R, G, and B subpixels. Each of the phosphor layers 125 is formed on a surface between adjacent base portions 124*a*, on upper surfaces of the base portions 124*a*, on side surfaces of protruding portions 124*b* on the based portions 124*a*, and on side surfaces of vertical barrier walls 126. In other words, each of the phosphor layers 125 is continuously formed across a corresponding main discharge space S1 and corresponding stepped spaces S2. This phosphor structure may be obtained using a continuous coating process where phosphor paste is coated on a single row of unit cells S at a time. In particular, portions of the phosphor layers 125 formed on the base portions 124*a* are close to the discharge electrode pairs (X,Y), which generate a display discharge, and thus may be effectively excited. Also, the portions of the phosphor layers 125 formed on the base portions 124*a* are closer to the front substrate 110, which forms a display plane, than the other portions of the phosphor layers 125 and face a display direction, so that visible light VL generated in the phosphor layers 125 may be immediately emitted to the outside via the front substrate 110 above the phosphor layers 125, thereby increasing the efficiency of extracting visible light.

In a related art phosphor structure where a large portion of a phosphor layer is attached to side surfaces of a barrier wall, flowable phosphor paste fails to adhere to the barrier walls due to gravity and flows down, and thus phosphor remaining on the side surfaces has a small thickness or an irregular thickness. In addition, visible light is discharged in the side surface direction of the barrier walls, and thus light extraction efficiency is lowered. In this embodiment of the present invention, the phosphor layer 125 existing on the upper surfaces of the base portions 124*a*, which are close to the display plane and face the display direction, are formed due to the structure of the stepped barrier walls 124 and barrier walls 126, and thus phosphor paste remains on and is stably attached to the upper surfaces of the base portions 124*a*. Therefore, the efficiency of extracting the visible light VL emitted upward from the phosphor layers 125 may increase, and light-emission brightness may increase.

Figure 3:
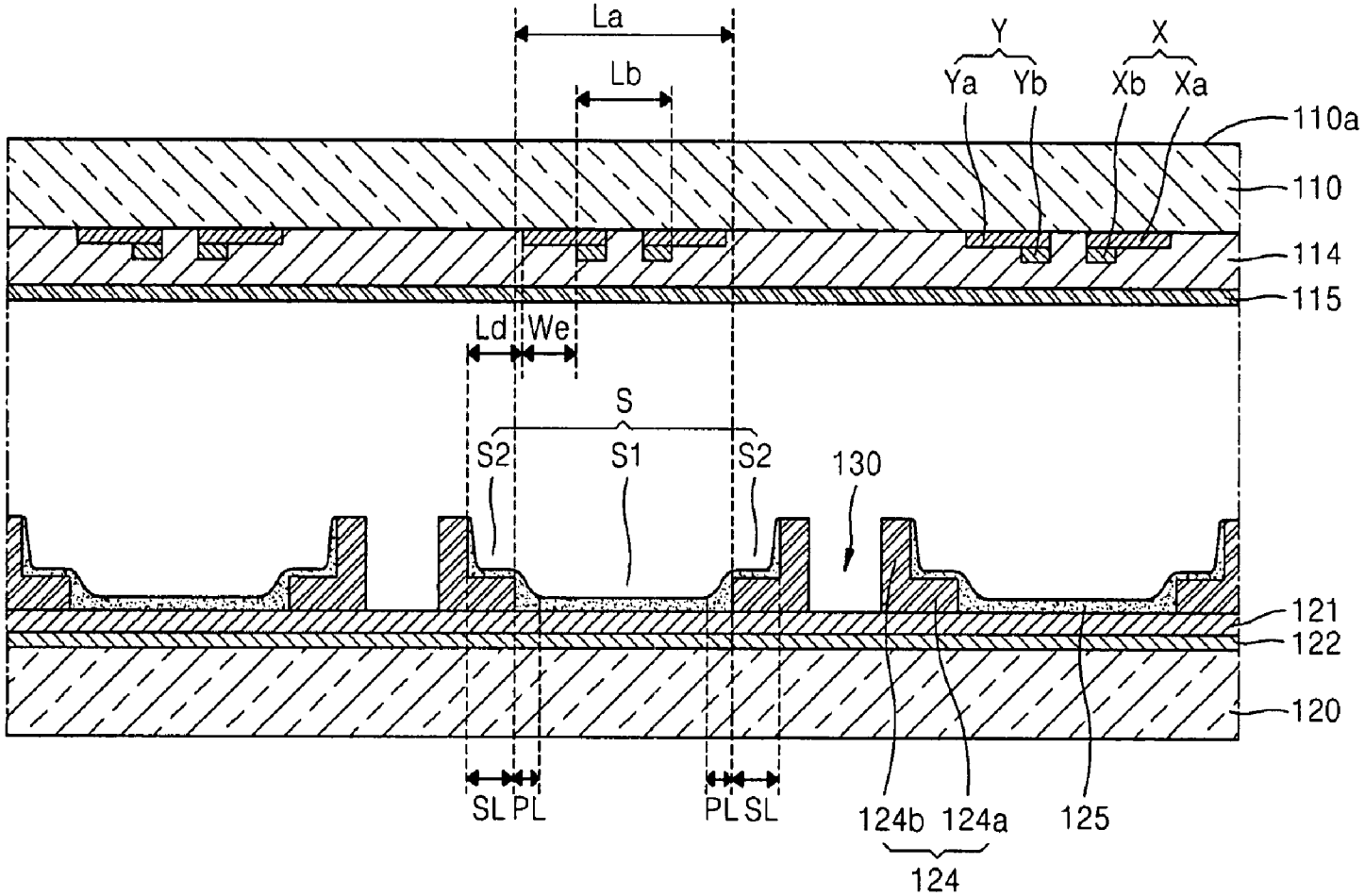
FIG. 3 is a vertical cross-section taken along line III-III of FIG. 1.

FIG. 3 is a vertical cross-section taken along line III-III of FIG. 1. Referring to FIG. 3, base portion areas SL formed on either side of each main discharge space S1 are light-emission areas in which display light-emission is concentrated by extracting visible light VL from the phosphor layers 125, which are close to a display plane 110*a*, with high efficiency. Since the bus electrodes Xb and Yb, which constitute a part of the discharge electrode pairs (X,Y), may be formed of an opaque metal conductive material, the bus electrodes Xb and Yb are disposed away from the base portion areas SL where light emission is concentrated. In other words, each pair of bus electrodes Xb and Yb that generate a mutual discharge may be disposed in an inside area of each unit cell S so as not to overlap the two base portion areas SL formed on either side of each main discharge space S1, and disposed in the main discharge space S1 thereof instead of in the base portion areas SL. A distance Lb between respective outer ends of adjacent bus electrodes Xb and Yb in each unit cell S may have a relationship of $La-Lb>10\ \mu m$, where La is a distance between respective ends of the base portions 124*a* formed on either side of each main discharge space S1. This will now be described in greater detail.

In other words, phosphor paste coated in each unit cell S flows along the surfaces of the barrier walls 124 and sticks to the surfaces thereof. At this time, phosphor layers 125 each having a large thickness of 5 μm or greater may be formed by the phosphor paste locally accumulating on ends of the base portions 124*a* where the phosphor paste changes its flow direction. In this way, phosphor-accumulated areas PL are obtained, and the phosphor accumulated areas PL may form an area where display light-emission concentrates, together with the base portion areas SL. For this reason, the opaque bus electrodes Xb and Yb may be disposed to be biased toward the centers of the unit cells S so as not to overlap the base portion areas SL and the phosphor accumulated areas PL. Since it is desirable that the bus electrodes Xb and Yb on either side of each unit cell S are biased toward the center of the unit cell S by 5 μm or more, respectively, from the ends of the base portions 124*a*, the relationship of $La-Lb>10\ \mu m$ is derived.

Two transparent electrodes Xa and Ya connected to the bus electrodes Xb and Yb extend toward the stepped spaces S2 so as to be farther from each other. Extended widths We of the transparent electrodes Xa and Ya, which correspond to lengths extended from the bus electrodes Xb and Yb, may be at least 10 μm. Due to this increase in the sizes of the transparent electrodes Xa and Ya, a discharge electric field is formed over a large area, and portions of the phosphor layers 125 formed on the base portions 124*a* are effectively excited, thereby increasing discharge efficiency. However, if ends of the transparent electrodes Xa and Ya extend up to locations very close to the protruding portions 124*b*, charge loss, which is a phenomenon in which charges accumulated in the transparent electrodes Xa and Ya leak through the protruding portions 124*b*, occurs. Therefore, a distance Ld between the transparent electrodes Xa and Ya and the protruding portions 124*b*, respectively, may be at least 10 μm in order to increase driving efficiency. Consequently, the transparent electrodes Xa and Ya may extend from the bus electrodes Xb and Yb by the extended width We of at least 10 μm, and at the same time extended ends of the transparent electrodes Xa and Ya may be apart from the protruding portions 124*b* by the distance Ld of at least 10 μm.

A discharge gas (not shown) that acts as an UV light generator is injected into the unit cells S. The discharge gas may be a multi-element gas in which xenon (Xe), krypton (Kr), helium (He), neon (Ne), and the like capable of providing UV light through discharge excitation are mixed at a determined volumetric ratio. A related art high-Xe display panel provides high luminous efficiency, but requires a high discharge firing voltage. Thus, such a related art high-Xe display panel has limitations in practical applications or extended applications when considering various circumstances such as an increase in driving power consumption and a circuit redesign for increasing rated power. However, in this embodiment of the present invention where a high electric field favorable to address discharge is formed through the base portions 124*a* of the barrier walls, a sufficient number of priming particles for discharge firing may be obtained, and thus a high-Xe plasma display may be implemented without an excessive increase in a discharging firing voltage, thereby significantly increasing luminous efficiency.

Figure 4:
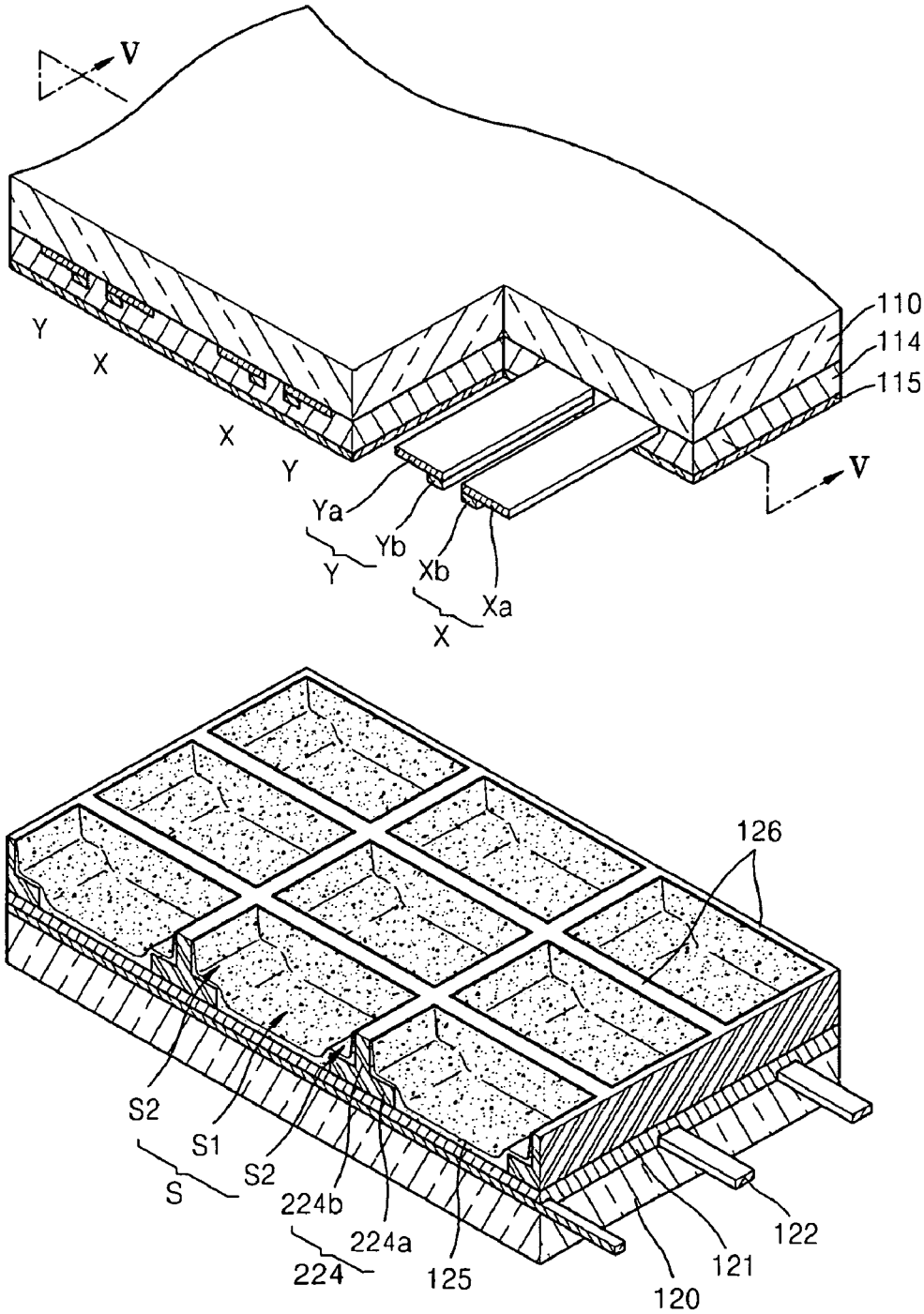
FIG. 4 is an exploded perspective view of a plasma display panel according to another embodiment of the present invention.
Figure 5:
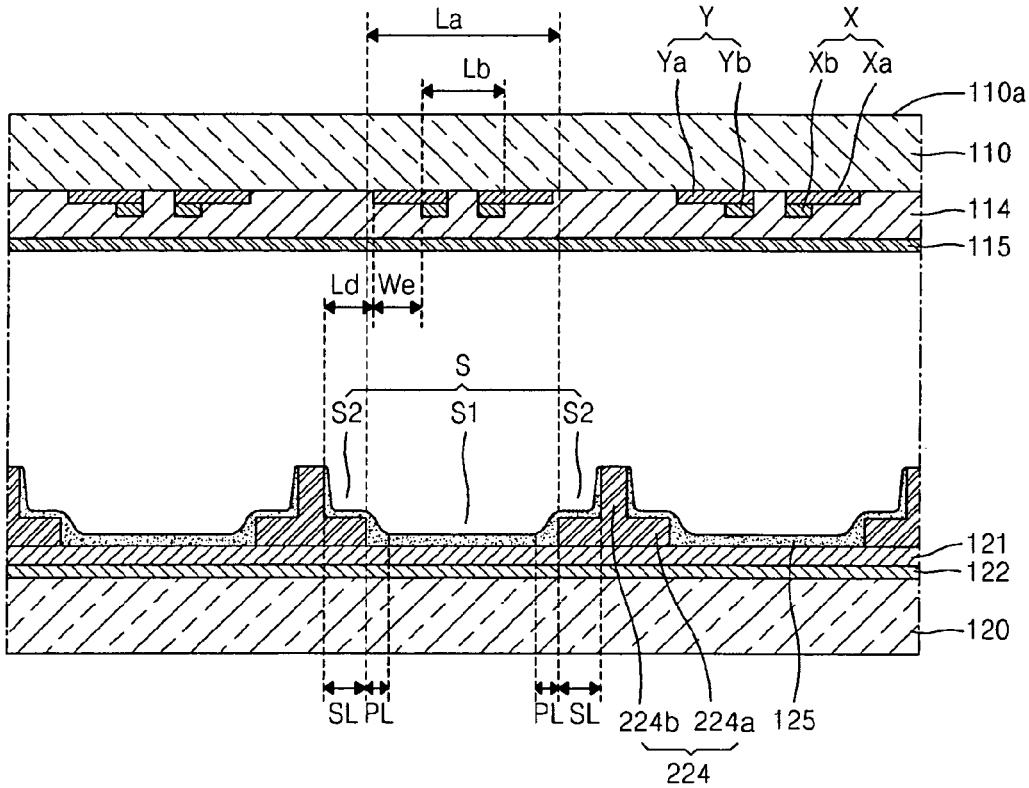
FIG. 5 is a vertical cross-section taken along line V-V of FIG. 4.

FIG. 4 is an exploded perspective view of a plasma display panel according to another embodiment of the present invention; and FIG. 5 is a vertical cross-section taken along line V-V of FIG. 4.

Referring to FIGS. 4 and 5, horizontal barrier walls 224 and the vertical barrier walls 126 that define a plurality of unit cells S are interposed between the front substrate 110 and the rear substrate 120 that face each other. The horizontal barrier walls 224 extend in one direction, and the vertical barrier walls 126 extend to cross the extending direction of the horizontal barrier walls 224. The horizontal barrier walls 224 each include a base portion 224*a* having a large width and a protruding portion 224*b* having a small width, thus defining a stepped space S2 on the stepped surface of each of the horizontal barrier walls 224. Stepped spaces S2 are formed on both sides of each main discharge space S1, respectively. A sustain electrode X and a scan electrode Y that generate a display discharge by interacting with each other include a pair of bus electrodes Xb and Yb, respectively, arranged in each main discharge space S1, and a pair of transparent electrodes Xa and Ya, respectively, extending toward the stepped spaces S2 existing on either side of the main discharge space S1. The bus electrodes Xb and Yb may be formed of an opaque metal conductive material and are disposed in each main discharge space S1 instead of in base portion areas SL and phosphor-accumulated areas PL in which visible light is extracted with high efficiency.

The bus electrodes Xb and Yb are designed so that a distance Lb between respective outer ends of adjacent bus electrodes Xb and Yb in each unit cell S may have a relationship of La−Lb>10 μm, where La is a distance between respective ends of the base portions 224*a* disposed on either side of the unit cell S. Extended widths We of the transparent electrodes Xa and Ya, which correspond to lengths extended from the bus electrodes Xb and Yb toward the stepped spaces S2, may be at least 10 μm. A distance Ld between extended ends of the transparent electrodes Xa and Ya and the protruding portions 224*b*, respectively, may be at least 10 μm. In contrast with the embodiment of FIGS. 1 through 3, no channel spaces are formed between adjacent horizontal barrier walls 224. The protruding portions 224*b* of the horizontal barrier walls 224 are formed on almost-central positions of the base portions 224*a*, and each of the horizontal barrier walls 224 define two adjacent unit cells S on either side thereof.

As described above, in a plasma display panel according to one or more of the above embodiments of the present invention, phosphor layers are disposed on the planes that are close to discharge electrodes that perform a mutual display discharge and to a light extraction plane, so that phosphor may be more effectively excited and the visible light extraction efficiency may increase. Due to shortening of an address discharge path, low-voltage addressing is possible, and a sufficient voltage margin may be secured. In particular, driving efficiency may be increased by improving the layout of discharge electrodes so that display light-emission in a high-brightness area where visible light is concentrated with high efficiency is not affected and charge loss is reduced.

It should be understood that the exemplary embodiments described herein should be considered in a descriptive sense only and not for purposes of limitation. Descriptions of features or aspects within each embodiment should typically be considered as available for other similar features or aspects in other embodiments.

What is claimed is:

1. A plasma display panel comprising:

a front substrate and a rear substrate that face each other;

a barrier wall, disposed on the rear substrate, comprising base portions arranged on either side of a main discharge space and protruding portions protruding on the base portions, and defining stepped spaces on either side of the main discharge space, wherein the stepped spaces are formed according to stepped surfaces formed by the base portions and the protruding portions;

a pair of electrodes disposed on the front substrate, the pair of electrodes comprising a scan electrode and a sustain electrode, the scan electrode comprising a transparent scan electrode and an opaque scan bus electrode disposed on said transparent scan electrode, and the sustain electrode comprising a transparent sustain electrode and an opaque sustain bus electrode disposed on said transparent sustain electrode, such that the scan and sustain bus electrodes are adjacent to each other and centrally disposed within the main discharge space;

an address electrode disposed on the rear substrate, the address electrode being elongated to cross an elongation direction of the scan electrode, the address electrode generating, together with the scan electrode, an address discharge;

a phosphor layer formed across the main discharge space and the stepped spaces; and a discharge gas filled in the main discharge space and the stepped spaces.

2. The plasma display panel of claim 1, the scan and sustain bus electrodes, which make a pair, being disposed in between the base portions arranged on either side of the main discharge space.

3. The plasma display panel of claim 1, a distance Lb between respective outer ends of the scan and sustain bus electrodes, which make a pair, having a relationship of La−Lb>10 μm, where La is a distance between the base portions disposed on either side of the main discharge space.

4. The plasma display panel of claim 1, extended widths of the transparent scan and sustain electrodes, not covered by the scan and sustain bus electrodes, being each at least 10 μm.

5. The plasma display panel of claim 1, wherein a distance between extended ends of the transparent scan and sustain electrodes and the protruding portions of the barrier wall is at least 10 μm.

6. The plasma display panel of claim 1, the barrier wall comprising:

a horizontal barrier wall comprising the base portions and the protruding portions and being elongated in one direction; and a vertical barrier wall elongated in a second direction crossing the direction in which the horizontal barrier walls are elongated.

7. The plasma display panel of claim 6, further comprising a channel space formed between adjacent horizontal barrier walls in a lengthwise direction of the horizontal barrier walls.

8. The plasma display panel of claim 1, the transparent scan electrode and the address electrode crossing with each other in an area adjacent to the stepped space.

9. The plasma display panel of claim 1, the transparent scan electrode and the address electrode crossing with each other in the stepped space.

10. A plasma display panel comprising:

a first substrate and a second substrate facing each other;

a plurality of horizontal barrier ribs on the second substrate between the first substrate and the second substrate forming a plurality of main discharge spaces and a plurality of stepped discharge spaces along a stepped surface of the barrier ribs;

a plurality of vertical barrier ribs crossing the horizontal barrier ribs to define a plurality of display cells comprising the main discharge spaces and stepped discharge spaces;

pairs of scan electrodes and sustain electrodes extending on the first substrate, the scan electrodes at locations overlapping with or adjacent to the stepped discharge spaces, the scan electrodes each comprising a transparent scan electrode and an opaque scan bus electrode disposed on said transparent scan electrode, and the sustain electrodes each comprising a transparent sustain electrode and an opaque sustain bus electrode disposed on said transparent sustain electrode, such that the scan and sustain bus electrodes are adjacent to each other and centrally disposed within the main discharge space, a distance Lb between respective outer ends, furthest from a center of the main discharge space, of the bus electrodes, having a relationship of La−Lb>10 μm, where La is a distance between the base portions disposed on either side of the main discharge space;

a plurality of address electrodes for generating address discharges together with the scan electrodes;

a plurality of phosphor layers respectively in the main discharge spaces and the stepped discharge spaces; and a discharge gas in the main discharge spaces and the stepped discharge spaces.

11. The plasma display panel of claim 10, the horizontal barrier ribs each comprising base portions and protruding portions extending above said base portions, said base portions and said protruding portions forming the stepped discharge space.

12. The plasma display panel of claim 10, further comprising a channel space formed between adjacent horizontal barrier ribs in a lengthwise direction of the horizontal barrier ribs.

13. The plasma display panel of claim 10, the horizontal barrier ribs each comprising base portions and protruding portions extending above said base portions, said base portions extending into adjacent display cells, said base portions and said protruding portions forming the stepped discharge space.

14. The plasma display panel of claim 10, extended widths of the scan and sustain transparent electrodes, not covered by the scan and sustain bus electrodes, each being each at least 10 μm.

15. The plasma display panel of claim 14, a distance between extended ends of the scan and sustain transparent electrodes and the protruding portions of the horizontal barrier ribs being at least 10 μm.

16. A plasma display panel comprising:

a front substrate and a rear substrate that face each other;

a barrier wall, disposed on the rear substrate, comprising base portions arranged on either side of a main discharge space and protruding portions protruding on the base portions, and defining stepped spaces on either side of the main discharge space, wherein the stepped spaces are formed according to stepped surfaces formed by the base portions and the protruding portions;

a pair of electrodes disposed on the front substrate, the pair of electrodes comprising a scan electrode and a sustain electrode comprising a pair of bus electrodes centrally disposed in the main discharge space and a pair of transparent electrodes extending, respectively, from the bus electrodes toward the stepped spaces on either side of the main discharge space, a distance Lb between respective outer ends of the bus electrodes, which make a pair, having a relationship of La−Lb>10 μm, where La is a distance between the base portions disposed on either side of the main discharge space;

an address electrode disposed on the rear substrate, the address electrode being elongated to cross an elongation direction of the scan electrode, the address electrode generating, together with the scan electrode, an address discharge;

a phosphor layer formed across the main discharge space and the stepped spaces; and a discharge gas filled in the main discharge space and the stepped spaces.

17. The plasma display panel of claim 16, extended widths of the transparent electrodes, not covered by the bus electrodes, being each at least 10 μm.

18. The plasma display panel of claim 16, wherein a distance between extended ends of the transparent electrodes and the protruding portions of the barrier wall is at least 10 μm.

19. The plasma display panel of claim 16, the barrier wall comprising:

a horizontal barrier wall comprising the base portions and the protruding portions and being elongated in one direction; and a vertical barrier wall elongated in a second direction crossing the direction in which the horizontal barrier walls are elongated.

20. The plasma display panel of claim 19, further comprising a channel space formed between adjacent horizontal barrier walls in a lengthwise direction of the horizontal barrier walls.

* * * * *